United States Patent [19]

Brodie et al.

[11] Patent Number: 4,818,649

[45] Date of Patent: Apr. 4, 1989

[54] METHOD FOR INTENSIFICATION AND REFLECTIVE READ-OUT OF UNDEREXPOSED FILM, RADIOGRAPHS, AND THE LIKE

[75] Inventors: Ivor Brodie, Palo Alto, Calif.; Malcolm Thackray, Cronulla, Australia

[73] Assignee: SRI International, Menlo Park, Calif.

[21] Appl. No.: 34,019

[22] Filed: Apr. 1, 1987

[51] Int. Cl.[4] ..... G03C 5/24; G03C 7/00; G03C 1/40; G03C 11/00

[52] U.S. Cl. ..... 430/21; 430/9; 430/16; 430/363; 430/373; 430/413; 430/414; 430/432; 430/945

[58] Field of Search ..... 430/9, 16, 21, 373, 430/363, 413, 432, 414, 945

[56] References Cited

U.S. PATENT DOCUMENTS

| | | | |
|---|---|---|---|
| 3,265,518 | 8/1966 | Lasky | 117/2 |
| 3,846,130 | 11/1974 | Purol | 96/22 |
| 3,988,602 | 10/1976 | Gorsica, Jr. | 235/150.1 |
| 4,113,490 | 9/1978 | Fujiwhara et al. | 430/373 |
| 4,164,788 | 8/1979 | Jain | 364/515 |
| 4,222,777 | 9/1980 | Nakajima et al. | 430/363 |
| 4,254,210 | 3/1981 | Van Stappen | 430/285 |
| 4,269,917 | 5/1981 | Drexler et al. | 430/16 |
| 4,278,756 | 7/1981 | Bouldin et al. | 430/16 |
| 4,284,716 | 8/1981 | Drexler et al. | 430/510 |
| 4,304,848 | 12/1981 | Bouldin et al. | 430/21 |
| 4,306,783 | 12/1981 | Murray | 353/121 |
| 4,315,318 | 2/1982 | Kato et al. | 364/515 |
| 4,317,179 | 2/1982 | Kato et al. | 364/515 |
| 4,323,641 | 4/1982 | Bond | 430/370 |
| 4,323,973 | 4/1982 | Greenfield | 364/515 |
| 4,366,235 | 12/1982 | Land | 430/496 |
| 4,526,860 | 7/1985 | Kitchin | 430/373 |
| 4,554,460 | 11/1985 | Klein | 250/578 |
| 4,571,635 | 2/1986 | Mahmoodi et al. | 358/284 |
| 4,684,602 | 8/1987 | Lelental et al. | 430/363 |

*Primary Examiner*—Mukund J. Shah
*Attorney, Agent, or Firm*—Victor R. Beckman

[57] ABSTRACT

Method and apparatus for intensification and reflective read-out of underexposed films, radiographs, and the like are shown which include means for converting a metallic silver particle image to a highly reflective image. The film containing the highly reflective image is placed in a black-walled cavity which may contain a particle-free liquid, such as water. The image is raster scanned by a laser beam, and light reflected from the image is detected by a photomultiplier. The photomultiplier output is digitized and the digitized signal is stored for subsequent computer enhancement and display.

11 Claims, 1 Drawing Sheet

METHOD FOR INTENSIFICATION AND REFLECTIVE READ-OUT OF UNDEREXPOSED FILM, RADIOGRAPHS, AND THE LIKE

ORIGIN OF THE INVENTION

The invention described herein was made in the course of work under a grant or award from the Department of Health and Human Services.

TECHNICAL FIELD

This invention relates to method and apparatus for the intensification and reading-out of underexposed or low optical density regions of properly exposed metallic silver photographic images contained for a protective medium on a film and produced by exposure of the film to light, x-ray, or like radiant energy in a photographic process such as a conventional silver halide photographic process.

BACKGROUND OF THE INVENTION

Photography, in general, involves the production of images through the action of radiant energy. A common photographic method makes use of silver halide crystals which are dispersed in a protective medium on a film backing, and which crystals are sensitive to radiant energy. With exposure to a radiant energy image, the exposed crystals become more sensitive to reduction. The exposed film is developed by reduction of the exposed silver halide grains, but not the unexposed grains, by use of a reducing agent thereby converting the silver halide to silver and the halide. The unsensitized silver halide grains are dissolved and washed away leaving an original silver particle image of the radiant energy image. For information retrieval using most prior art methods a minimum density above base fog of approximately 0.3 optical density units is required. The method of the present invention may be used for the enhancement of photographic images of even lower optical density.

Various methods for extracting information from underexposed films or radiographs containing a metallic silver particle image are known. One such method involves the deposition of copper on the silver image of a conventionally developed silver halide-emulsion film, as disclosed, for example, in U.S. Pat. No. 3,674,489 issued July 4, 1972. A basic problem with all such methods of intensification is that large amounts of material must be diffused through the gelatin matrix to increase the size of the grains forming the image. Some of this material frequently deposits at places other than the image and spoils the photograph. In addition, if the photographic image includes dense areas, such areas are completely blocked if sufficient material is deposited for image enhancement of the low optical density areas included thereon.

Autoradiographic photographic image enhancement methods also are known wherein the photographic image is made radiactive in an amount related to the the optical density thereof. The radioactive film is placed adjacent a radioactive-sensitive film for exposure thereof to nuclear radiation emitted thereby. Exposure to the radioactive image source continues until the film is properly exposed, after which it is developed. With such nuclear intensification technique, resolution is limited by the resolution of the original negative, the resolution of the autoradiographic film, the evenness of the autoradiographic film contact during exposure, and the range of the radioactive emissions. Since the random direction emissions cannot be conveniently focused, the highest resolution intensification is obtained by contact autoradiography. Additionally, such technique requires specialized equipment and personnel trained in radiochemistry.

Photoluminescence type image enhancement methods also are known as shown, for example, in U.S. Pat. No. 4,299,904 issued Nov. 10, 1981. There, underexposed photographic images are made photoluminescent by photoluminescent material applied to the image. The photoluminescent image then is exposed to photon excitation to excite the same to luminescence. The photon emission then is recorded for production of an intensified image of the underexposed photographic image. Some photoluminescent material is retained by the gelatin of the film and this reduces the image-to-fog fluorescence ratio and can cause serious loss of resolution on thick emulsion radiographs.

An object of this invention is the provision of an improved method and apparatus of photographic image enhancement which avoids many of the above and other shortcomings of prior art image enhancement methods.

An object of this invention is the provision of an improved method and apparatus for reading underexposed photographic films and radiographs which is well adapted for use with silver photographic or radiographic images having such low optical density, or contrast, that they are unreadable by many prior art methods.

An object of this invention is the provision of a method of the above-mentioned type which can be performed such that restoration of the original metallic silver photographic image is possible.

The above and other objects and advantages of this invention are achieved by increasing the reflectivity of the metallic silver image by, for example, converting the image to a silver halide image having substantially the same relative localized optical density as the metallic silver image. The converted image then is placed in a dark-walled cavity which may contain a liquid of suitable refractive index where it is scanned by an electromagnetic energy beam such as a laser beam. Liquid in the cavity, such as water, reduces light reflection from interfaces at the front and back surfaces of the film, and the dark walls of the cavity minimize light reflection therefrom. An electromagnetic energy detector, such as a photomultiplier tube, is positioned in the cavity to receive reflected light from the reflective image. The analog signal output from the detector is converted to digital signal form for storage in memory and subsequent computer processing and display.

The invention will be better understood from the following detailed description considered with the accompanying drawings.

BRIEF DESCRIPTION OF THE DRAWINGS

In the drawings, wherein like reference characters refer to the same parts in the several views.

Figure 1:
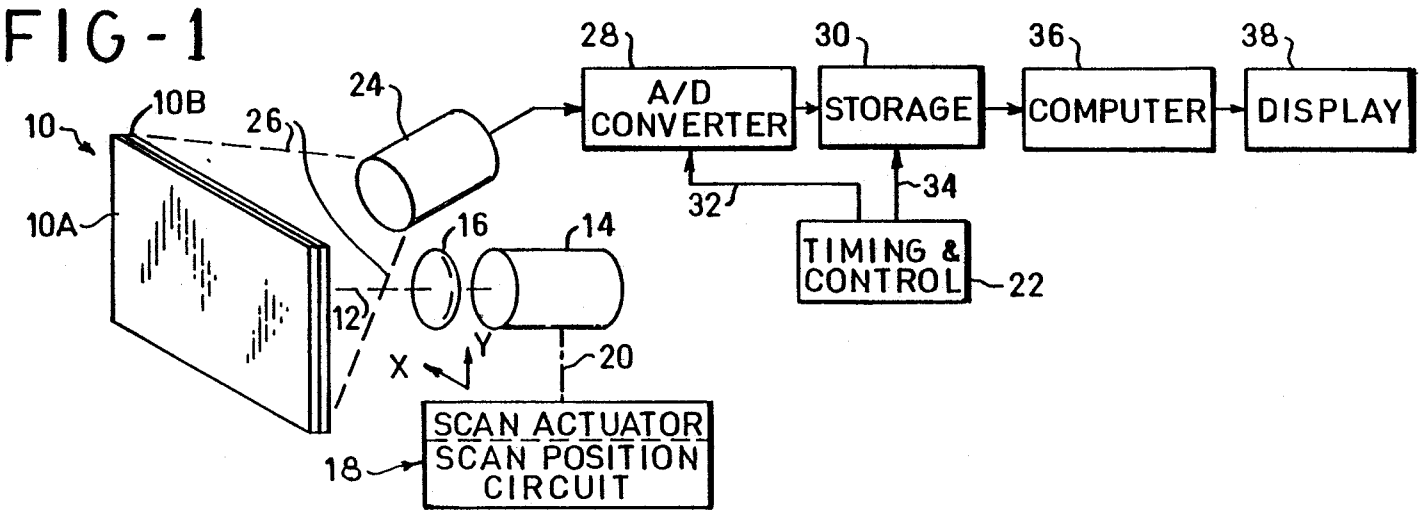
FIG. 1 is a block diagram showing an image scanning system of a type which may be used with the present invention.

As noted above, the photographic image enhancement method of the present invention includes increasing the reflection coefficients of the silver particles to electromagnetic energy of the wavelength used for scanning the image. The reflection coefficient of silver particles in developed films is very low due to their porous metallic structure. Reflectivity of the silver particle image may be increased by any suitable means including bleaching to reduce the visual blackness of the silver image. Over the long history of photography, many hundreds of methods have been studied for converting silver images into other chemical compounds. The techniques either intensified the image by adding more light-absorbing material or produced colored images. All color photography today is an example of the application of such reactions, dating back to simple sepia-toning of photographs by conversion of the image to silver sulfide. Many of the intermediate products formed in these reactions are lightly colored compounds and may be used in the practice of the present invention.

The simplest type of reaction to make the image reflective is to convert the image back to its silver halide form. This is the first step in most systems of color photography and many bleach solutions have been used. All such solutions incorporate an oxidizing agent, such as potassium ferricyanide and a source of halide ions, e.g. potassium bromide. Although these halides are not the most reflective compounds that can be formed, they have the advantage that the image can be converted back to its original metallic form by simple redevelopment.

Denser and more reflective images can be formed by oxidizing the silver under conditions where a double salt of silver and some other metal precipitate. Following are examples of these reactions.

One of the best known of these is the first stage in the intensification of images using mercury. The image is bleached using a solution of mercuric chloride to produce a mixture of silver chloride and mercurous chloride at image sites. Both are white.

The formula is:

$$HgCl_2+Ag \rightarrow HgCl+AgCl.$$

This image can also be converted back to metallic form by simple development; some intensification occurs, but generally is not important in the case of low-density radiographs.

The most common oxidizing agent used in the formation of these double salt images is potassium ferricyanide. As the silver image oxidizes to silver ferrocyanide, the reduction of ferricyanide ion to ferrocyanide allows precipitation of many other metal ions that may be present in solution. One well-known example of these reactions is iron blue toning, but this image is not very reflective and elements such as titanium and vanadium give brighter-colored ferrocyanides. If cadmium ferrocyanide is formed by this process, it can be converted to the bright yellow pigment cadmium sulfide by treatment with a soluble sulfide. This series of reactions can be represented as follows:

$$4[Fe(CN)_6]^{3-}+6Cd^{2+}+4Ag \rightarrow 3Cd_2[Fe(CN)_6]+Ag_4[Fe(CN)_6]$$

the silver ferrocyanide is then removed with a suitable fixer since silver forms a dark brown sulfide $$Cd_2[Fe(CN)_6]+2Na_2S \rightarrow 2CdS+Na_4[Fe(CN)_6].$$

Many such reflective pigments can be formed by similar reactions.

Figure 2:
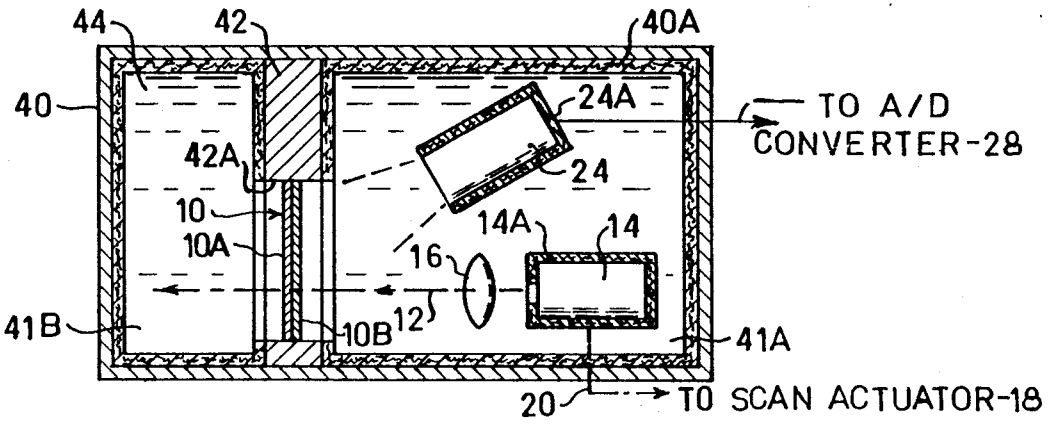
FIG. 2 is a sectional view through a cavity which may contain liquid within which the reflective film is located for scanning thereof.

After conversion of the silver grains to a compound of increased reflectivity, the film is scanned by an electromagnetic energy beam having a spot size of that of the minimum pixel required to be viewed. A photon energy beam such as focused laser beam is well suited for this purpose. An optical system for scanning the highly reflective image is shown in FIGS. 1 and 2, to which figures reference now is made. The film which carries the image is identified by the reference numeral 10 and is shown to include a film base or support 10A coated with an emulsion layer 10B containing the highly reflective image. The film base often is transparent to allow for the transmission of light therethrough, and in the drawings a transparent film base is shown. The film is scanned by an electromagnetic energy beam 12 provided by radiation source 14 operating at or near the optical frequency range. If desired, the source may comprise a laser, illumination form which preferably is focused on the image contained in emulsion layer 10B by a suitable lens or lens system 16 for highly localized reflection from image particles therein. For scanning radiographs, a spot size on the order of 100 μm may be used.

The beam 12 is raster scanned across the film 10 in the x and y directions shown in FIG. 1. For purposes of illustration only, relative scanning of the beam and film is provided by movement of the laser 14 and associated focusing lens means 16 in the x and y directions by operation of scan actuator 18 connected thereto through mechanical linkage 20. The scanning mechanism includes a scan position information circuit having an output connected to timing and control unit 22 which, in turn, has outputs for synchronizing signal receiving operations described below. Obviously, other scanning means may be employed including, for example, movement of the film, pivotally actuated mirrors for deflecting the beam, a pivotally movable laser, and the like. Numerous means for raster beam scanning are well known and no detailed description thereof here is required.

Radiation reflected from the illuminated spot of the image carried by film 10 is viewed by a detector 24 having a large acceptance solid angle 26, as shown in FIG. 1. Detector 24 comprises, for example, a photomultiplier which is very sensitive to incident radiation of the wavelength of the laser beam. The analog output from detector 26 is digitized as by use of an analog-to-digital converter 28, and the digital signal output from the converter is stored in storage unit 30. The analog-to-digital converter operates at a sampling rate established by control signals from timing and control unit 22 supplied thereto over timing line 32. Also, timing and control signals from unit 22 are supplied to storage unit 30 over line 34, which signals include horizontal and vertical synchronization signals that are synchronized with the raster scanning motion of the illuminating beam 12 for sequential storage of lines of information from the scanned image. From storage 30, the signal is supplied to a computer 36 for processing and display at display unit 38.

As seen in FIG. 2 the base scanning operation takes place within a container, or cavity, 40. To minimize extraneous reflected light the laser, detector, and cavity walls are provided with a black light-absorbing surface. Any suitable light-absorbing surface may be used including a black coating, or film, a black fabric such as velvet, or the like. In the drawings, the light-absorbing surfaces on the laser, detector and cavity are identified by reference characters 14A, 24A and 40A, respectively.

The cavity includes a dividing wall 42 that separates the cavity into first and second chambers 41A and 41B. The film to be scanned is located at an aperture 42A formed in the dividing wall. The laser 14 and detector 24 are located at the same side of the film and, in the illustrated arrangement, are shown located within chamber 40A.

If desired, the film 10 to be scanned may be immersed in liquid 44 within the container 40 to provide for a liquid-emulsion interface at the front of the film and a liquid-film base interface at the rear thereof. A particle-free liquid 44, such as water, glycerol, or the like, may be employed, the refractive index of which more nearly matches that of the emulsion and film base than that of air. Consequently, reflection is minimized at the film-liquid interfaces.

Although operation of the invention is believed to be apparent, a brief description thereof now will be given. The metallic silver image of the underexposed film or radiograph first is converted to a highly reflective image as, for example, by bleaching to form a reflective silver compound, such as a silver bromide. The film 10 containing the highly reflective image is placed in black-walled cavity, 40 which may contain a clear liquid 44, which liquid minimizes reflection at the film-liquid interfaces. The film is raster scanned by a radiant energy beam 12, such as a laser beam having a small spot size. During scanning, the film is viewed by detector 24 comprising, for example, a photomultiplier with a large acceptance solid angle 26. The signal output from detector 24 is digitized by analog to digital converter 28 and the digitized signal is supplied to storage 30. Computer enhancement of the digitized signal is provided by computer 36 and the enhanced signal is displayed at display unit 38.

With the reflection method of the present invention density variations in images can be measured and digitized to much lower exposures than, say, transmission type methods wherein the detector is located at the opposite side of the film from the radiation beam source. Transmission methods fail completely when photographic negatives are very lightly exposed as, for example, when low x-ray doses are employed.

The invention having been described in detail in accordance with requirements of the Patent Statutes, various changes and modifications will suggest themselves to those skilled in this art. For example, converting the silver grain image to a highly light-reflecting image need not involve a bleaching process. Also, a bleached image may be toned as by adsorption of a light-colored dye by the silver halide image, which dye is held in the same relative position and in the same proportion as the density of the silver halide. In addition, although direct light paths are shown between the laser and film, and between the film and detector, indirect paths involving the use of mirrors, or the like, may be employed. Further, if a liquid is employed for improved signal to noise ratio, the laser, detector, and film need not be completely submerged in the liquid. For example, windows may be included in the cavity walls which are closed by the active faces of the laser and detector or through which ends thereof extend. Also, an objective lens, or lens system, may be included for viewing reflected light with the detector. Additionally, the analog signal output from detector 24 may be processed for viewing without conversion thereof to digital form. It is intended that the above and other such changes and modifications shall fall within the spirit and scope of the present invention as defined in the appended claims.

We claim:

1. In a method for the intensification and reflective read-out of underexposed or low optical density regions of properly exposed metallic silver particle photographic images contained in the protective medium of a film the steps including, converting the metallic silver particle image to a more reflective image, scanning the converted image from one side thereof with a beam of electromagnetic radiation having a small spot size at the converted image, viewing radiation reflected from the converted image at said one side with a detector having a signal output proportional to incident radiation, and converting the detector output for visual display of an intensified image of the metallic silver particle, photographic image, resolution of the intensified image being dependent upon the spot size of the scanning beam at the converted image.

2. In a method as defined in claim 1 wherein the converting step includes bleaching the metallic silver particle image.

3. In a method as defined in claim 2 wherein the metallic silver particle image is converted to a silver bromide image by said bleaching.

4. In a method as defined in claim 1 wherein the scanning step comprises scanning with a laser beam.

5. In a method as defined in claim 4 including focusing the laser beam at the converted image.

6. In a method as defined in claim 5 wherein the spot size of the laser beam at the converted image is about 100 μm.

7. In a method as defined in claim 1 wherein the converted image is raster scanned with said radiation beam.

8. In a method as defined in claim 1 wherein the viewing step comprises viewing reflected radiation with a photomultiplier with a large acceptance solid angle which subtends the scanned image.

9. In a method as defined in claim 1 including placing the converted film in a liquid during scanning and viewing thereof to minimize reflection at the film surface.

10. In a method as defined in claim 1 including locating the converted film in a black-walled cavity during scanning and viewing to minimize extraneous reflected light from viewing by the detector.

11. In a method as defined inclaim 10 including providing liquid in the cavity within which liquid the converted film is located to minimize reflection from the surface of the converted film.

* * * * *